US005860045A

United States Patent [19]

Sakamoto et al.

[11] Patent Number: 5,860,045

[45] Date of Patent: Jan. 12, 1999

[54] IMAGE FORMING METHOD

[75] Inventors: Mitsutoshi Sakamoto, Osaka; Hiroshi Sakai, Sakai, both of Japan

[73] Assignee: Minolta Co., Ltd., Osaka, Japan

[21] Appl. No.: 936,601

[22] Filed: Sep. 24, 1997

[30] Foreign Application Priority Data

Sep. 25, 1996 [JP] Japan ..... 8-275418

[51] Int. Cl.[6] ..... G03G 21/00

[52] U.S. Cl. ..... 399/128; 399/50; 399/71

[58] Field of Search ..... 399/38, 50, 51, 399/52, 53, 54, 55, 71, 127, 128, 129, 130, 159, 160, 343, 358, 359

[56] References Cited

U.S. PATENT DOCUMENTS 4,785,324 11/1988 Yamazaki et al. ..... 399/128
4,897,333 1/1990 Matsushita ..... 430/126
5,112,709 5/1992 Yamazaki et al. ..... 399/159 X
5,701,560 12/1997 Tsujita et al. ..... 399/159

FOREIGN PATENT DOCUMENTS 61041155 2/1986 Japan .

*Primary Examiner*—Arthur T. Grimley
*Assistant Examiner*—Hoan Tran
*Attorney, Agent, or Firm*—McDermott, Will & Emery

[57] ABSTRACT

In an image forming method in which an image is formed through the charging, exposing, developing, transferring, and charge eliminating steps using an amorphous silicon photoreceptor having an amorphous silicon photosensitive layer, an image forming method according to the present invention is so adapted that letting t1 be a time period from the charging step to the developing step and t2 be a time period from the charge eliminating step to the charging step, the value of t2/t1 is not less than one.

14 Claims, 3 Drawing Sheets

IMAGE FORMING METHOD

BACKGROUND OF THE INVENTION

1. Field of the Invention

The present invention relates to an image forming method in which in an image forming apparatus such as a copying machine or a printer, image formation is carried out using an amorphous silicon photoreceptor having an amorphous silicon photosensitive layer composed of amorphous silicon, which is characterized in that charging properties in the amorphous silicon photoreceptor are improved in carrying out image formation through the charging, exposing, developing, transferring and charge eliminating steps to stably form a good image at high speed.

2. Description of the Related Art

Conventionally in forming an image in an image forming apparatus such as a copying machine or a printer, an amorphous silicon photoreceptor using amorphous silicon has been used in addition to an organic photoreceptor using selenium or the like as a material composing its photosensitive layer and an organic photoreceptor using an organic material as the material.

When an image is formed using such an amorphous silicon photoreceptor, the surface of the amorphous silicon photoreceptor is charged by a charger, the surface of the photoreceptor thus charged is then subjected to exposure corresponding to image information to form an electrostatic latent image, toner is supplied to the electrostatic latent image thus formed from a developing device to form a toner image on the surface of the photoreceptor, the toner image is transferred onto a recording medium by a transferer or the like to form the toner image on the recording medium, while the toner remaining on the surface of the photoreceptor after the transfer is removed by a cleaning device, and light is then irradiated onto the surface of the photoreceptor from a charge eliminating device to eliminate charge remaining on the surface of the photoreceptor, as in the case of the other photoreceptor.

The above-mentioned amorphous silicon photoreceptor can be utilized at higher speed and over a longer period, as compared with the other photoreceptor, because its photosensitive layer has a high hardness, and has high sensitivity and high charge transporting properties.

In the case of the amorphous silicon photoreceptor, however, the photosensitive layer has a lot of dangling bonds. Part of carriers produced by light are acquired by the dangling bonds, so that the movability of the carriers is decreased, and the probability that the carriers are re-combined is decreased. Consequently, the carriers are liable to remain as an optical memory. When the amorphous silicon photoreceptor is repeatedly used, therefore, the carriers produced in the previous exposing step remain as an optical memory until the surface of the photoreceptor is then charged, so that image noise referred to as "ghost" occurs.

Conventionally in the charge eliminating step for eliminating charge remaining on the surface of the amorphous silicon photoreceptor, therefore, light having a depth in entrance which is approximately the same as the depth in entrance of light having a main wavelength for performing exposure is irradiated as light irradiated from the charge eliminating device to eliminate the above-mentioned charge.

When the light having a depth in entrance which is approximately the same as the depth in entrance of light having a main wavelength for performing exposure is thus irradiated, however, a lot of latent carriers are produced inside the photosensitive layer.

When an image is formed at high speed, therefore, the subsequent charging is performed by the charger before the carriers thus produced are re-combined. The carriers are moved at the time of the charging, so that a surface potential on the photoreceptor is decreased, resulting in significantly decreased charging properties in the photoreceptor.

If charging conditions by the charger are made severe in order to sufficiently charge the amorphous silicon photoreceptor, a part of the photosensitive layer is subjected to dielectric breakdown, producing a pin hole. Consequently, noise occurs in the formed image.

In order to improve charging properties in such an amorphous silicon photoreceptor, it has been proposed that the thickness of its photosensitive layer is increased, and a time period from charge elimination using light to charging is set to not less than 200 msec, to recombine latent carriers produced inside its photosensitive layer by the charge elimination using light in a period elapsed until the subsequent charging is performed, as disclosed in Japanese Patent Laid-Open No. 41155/1986.

Even when the thickness of the photosensitive layer is increased as described above, however, the charging properties in the amorphous silicon photoreceptor cannot be sufficiently improved. Further, in the above-mentioned gazette, the time period from charge elimination using light to charging is only specified, and a time period from charging to development is not described. Moreover, if the rotational speed of the amorphous silicon photoreceptor is increased in order to form an image at high speed, it is significantly difficult to ensure not less than 200 msec as the time period from charge elimination using light to charging from the relationship with the other steps such as the developing and transferring steps in an electrophotographic process.

SUMMARY OF THE INVENTION

An object of the present invention is to prevent, in forming an image using an amorphous silicon photoreceptor, a surface potential on a photoreceptor from being decreased upon movement of latent carriers produced inside its photosensitive layer by charging in the subsequent image forming process of the photoreceptor.

Another object of the present invention is to improve charging properties in an amorphous silicon photoreceptor in forming an image at high speed using the amorphous m silicon photoreceptor.

Still another object of the present invention is to make it possible to stably form a good image at high speed using an amorphous silicon photoreceptor.

In an image forming method in which an image is formed through the charging, exposing, developing, transferring and charge eliminating steps using an amorphous silicon photoreceptor having an amorphous silicon photosensitive layer, an image forming method according to the present invention is so adapted that letting t1 be a time period from the charging step to the developing step and t2 be a time period from the charge eliminating step to the charging step, the value of t2/t1 is not less than one.

When letting t1 be the time period from the charging step to the developing step and t2 be the time period from the charge eliminating step to the charging step, the value of t2/t1 is not less than one, as in the image forming method according to the present invention, the time period t2 from the charge eliminating step to the charging step is lengthened in all the steps in which an image is formed. Even when an image is formed at high speed, therefore, latent carriers produced inside the photosensitive layer by charge elimination using light are decreased upon being re-combined to some extent. Further, the time period t1 from the charging step to the developing step is shortened. Consequently, the amount of carriers moved to the surface of the amorphous silicon photoreceptor is decreased in a period elapsed since the amorphous silicon photoreceptor was charged until development is performed, so that a surface potential on the amorphous silicon photoreceptor is prevented from being decreased at the time of development, resulting in improved charging properties.

There and other objects, advantages and features of the invention will become apparent from the following description thereof taken in conjunction with the accompanying drawings which illustrate specific embodiment of the invention.

DESCRIPTION OF THE PREFERRED EMBODIMENTS

A developing device according to a preferred embodiment of the present invention will be specifically described on the basis of accompanying drawings.

An amorphous silicon photoreceptor used for an image forming method according to the present embodiment is not particularly limited, and a known amorphous silicon photoreceptor generally used can be used. The thickness or the like of an amorphous silicon photosensitive layer formed on the surface of the amorphous silicon photoreceptor is not particularly limited. The thickness of the amorphous silicon photosensitive layer is generally 20 to 100 $\mu$m. Particularly in order to form an image at high speed by improving charging properties in the amorphous silicon photoreceptor, it is preferable that the thickness of the amorphous silicon photosensitive layer is not less than 50 $\mu$m.

Figure 1:
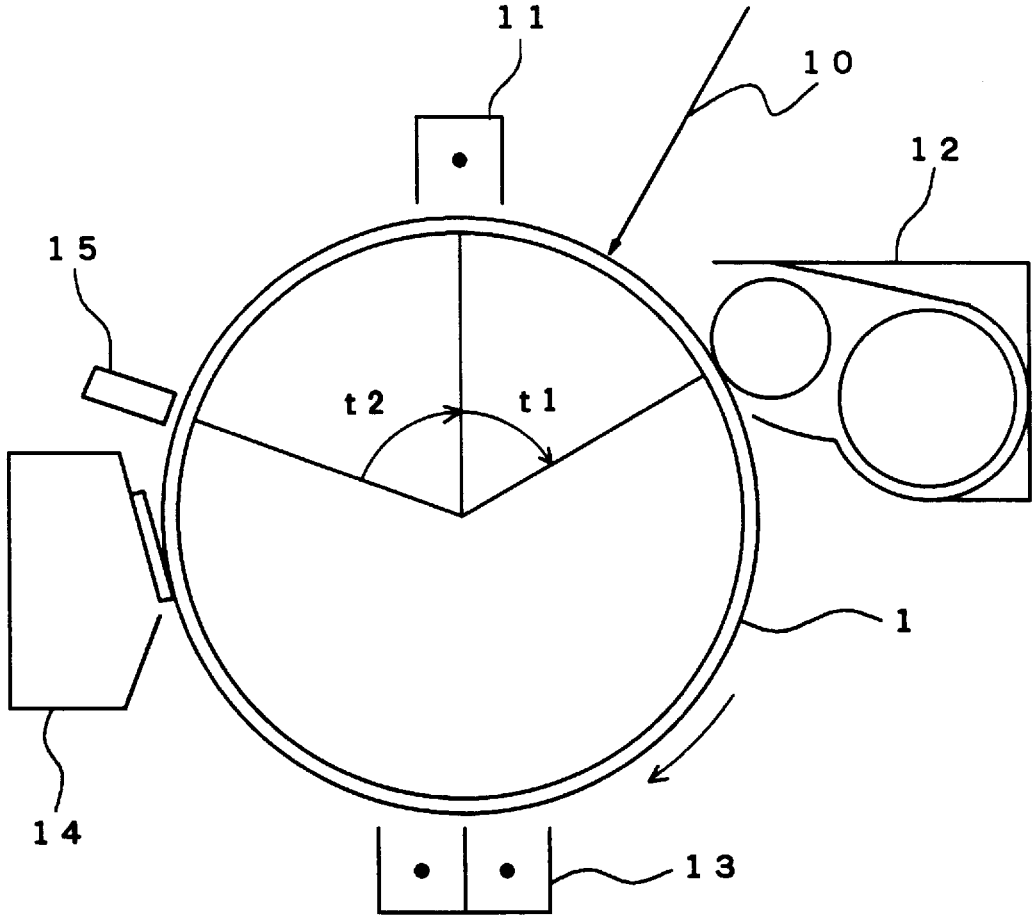
FIG. 1 is a schematic explanatory view showing one example of an apparatus for carrying out an image forming method according to the present invention.

In forming an image using such an amorphous silicon photoreceptor, a photoreceptor 1 is rotated, as shown in FIG. 1, to charge the surface of the photoreceptor 1 by a charger 11 such as a corona charger. Preferably, the surface of the amorphous silicon photoreceptor is positively charged.

Although the system speed at which an image is formed by rotating the photoreceptor 1 as described above is not particularly limited, it is preferably 200 to 1000 mm/sec, which is effective in forming an image at a high speed of 500 to 1000 mm/s.

The surface of the photoreceptor 1 charged as described above is then subjected to exposure 10 corresponding to image information from exposing means (not shown), for example, digital exposure such as laser, LED (light emitting diode), and PLZT (lead lanthanum zirconate titanate) or analog exposure for irradiating light reflected from an original by a mirror or the like, to form an electrostatic latent image on the surface of the photoreceptor 1.

A developer is supplied from a developing device 12 to the surface of the photoreceptor 1 having the electrostatic latent image thus formed thereon, to form a toner image corresponding to the electrostatic latent image on the surface of the photoreceptor 1. Examples of the developer used for the developing device 12 include a monocomponent developer using only toner and a two-component developer having toner and carriers mixed with each other. It is also possible to add particles of an abrasive material or the like to the developer. Further, development using the developing device 12 may be either reversal development or regular development. Preferably, the reversal development is performed using positively-charged toner.

The toner image formed on the surface of the photoreceptor 1 in the above-mentioned manner is then transferred onto a transfer member such as paper (not shown) through a transferring and separating charger 13, and the toner image thus transferred onto the transfer member is fixed on the transfer member in a fixing device (not shown).

Figure 3:
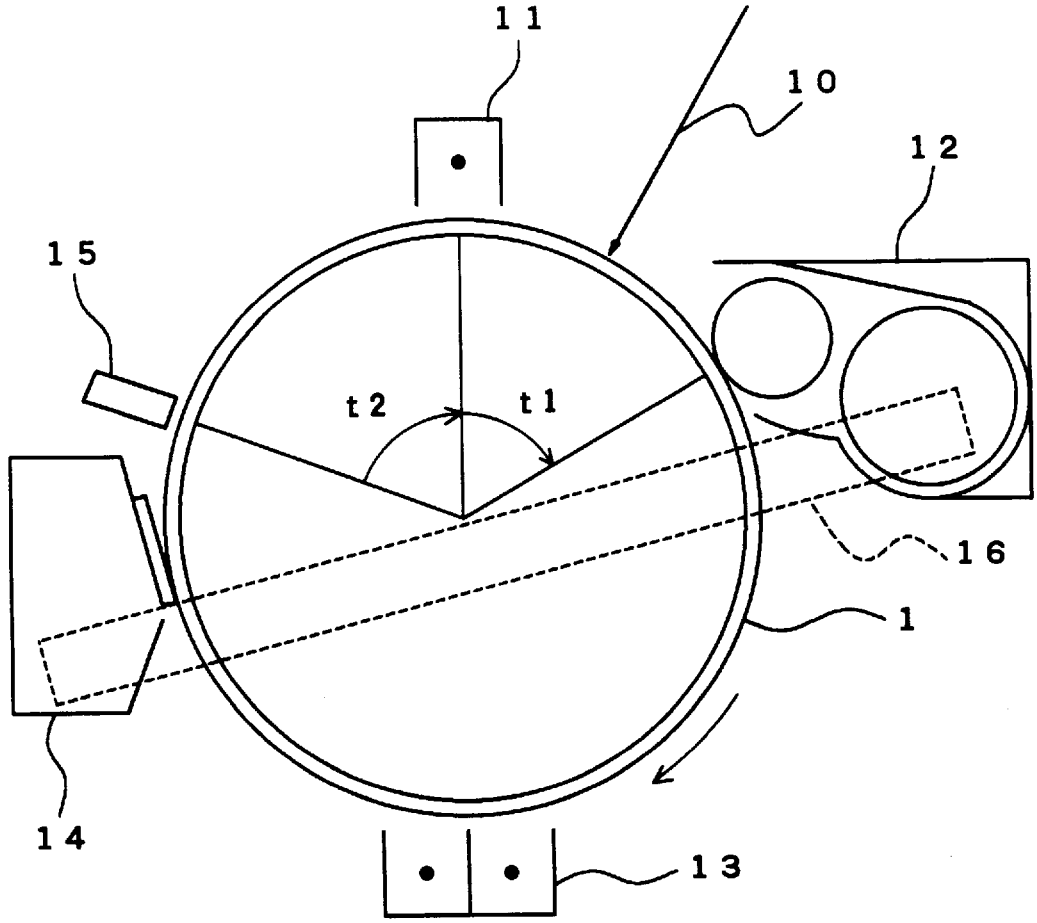
FIG. 3 is a schematic explanatory view showing another example of an apparatus for carrying out the image forming method according to the present invention.

On the other hand, after the toner image is transferred onto the transfer member as described above, the toner remaining on the surface of the photoreceptor 1 is removed by a cleaning device 14, after which light is irradiated from a charge eliminating device using light 15 such as LED or a cold-cathode tube onto the surface of the photoreceptor 1, to eliminate charge remaining on the surface of the photoreceptor 1. As shown in FIG. 3, the toner recovered by the cleaning device 14 is supplied to the developing device 12 again by a recycling device 16.

In an image forming method according to the present embodiment, letting t1 be a time period elapsed since the surface of the photoreceptor 1 was charged by the charger 11 as described above until development is performed upon supplying the developer to the surface of the photoreceptor 1 from the developing device 12, and t2 be a time period elapsed since the charge remaining on the surface of the photoreceptor 1 was eliminated upon irradiating light from the charge eliminating device using light 15 until the photoreceptor 1 is charged by the charger 11, the value of t2/t1 is set to not less than one, and the time period t1 from charging to development is made equal to or shorter than the time period t2 from charge elimination to charging.

As a result, the time period t2 from charge elimination to charging is lengthened as described above. Consequent1y, latent carriers produced inside the photoreceptor 1 by charge elimination using light are decreased upon being re-combined to some extent even when an image is formed at high speed. Further, the time period t1 from charging to development is shortened. Consequent1y, the amount of carriers moved to the surface of the photoreceptor 1 in a period elapsed since the photoreceptor 1 was charged until development is performed is decreased, so that a surface potential on the photoreceptor 1 is prevented from being decreased before development is performed. Although in the present invention, a desired effect of the present invention can be achieved if t2/t1 is not less than one. On the other hand, an apparatus for carrying out the image forming method exceeds the design requirement if t2/t1 is set to a too large value. In the present invention, therefore, it is preferable that the value of t2/t1 is not more than approximately two. Further, t2 is preferably less than 200 msec, and more preferably 30 to 180 msec from the above-mentioned point of view.

Specific examples of the image forming method according to the present invention will be described, and it will be made clear that a good image is stably obtained using the image forming method according to the present invention by taking comparative examples.

In examples 1 to 4 and comparative examples 1 to 3, a commercially available amorphous silicon photoreceptor having an amorphous silicon photosensitive layer whose thickness is 80 $\mu$m (PPC-H; made by Kyocera Corporation) was used as an amorphous silicon photoreceptor.

Figure 2:
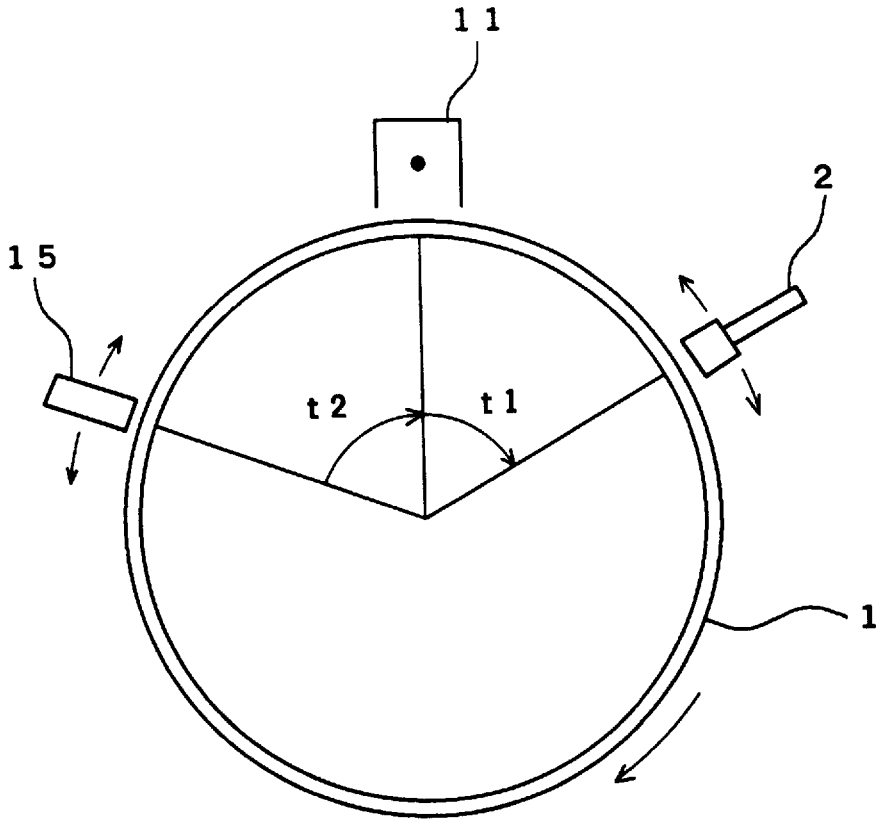
Fig. 2 is a schematic explanatory view of a tester used for finding the amount of charge required to so charge a photoreceptor by a charger that a surface potential the on is a predetermined potential in examples and comparative examples of the present invention.

The amorphous silicon photoreceptor 1 was set in a tester as shown in FIG. 2, and was rotated at a peripheral speed of 250 mm/s in the example 1 and the comparative example 1, a peripheral speed of 500 mm/s in the example 2 and the comparative example 2, and a peripheral speed of 750 mm/s in the examples 3 and 4 and the comparative example 3, respectively, to charge the surface of the photoreceptor 1 thus rotated by the charger 11 using a corotron charger.

An electrometer 2 for measuring a surface potential on the photoreceptor 1 thus charged was suitably arranged so as to correspond to the position of a developing device for developing the charged photoreceptor 1, to measure the surface potential on the photoreceptor 1 by the electrometer 2. Thereafter, light for charge elimination whose luminous energy is 5 lux·s was irradiated onto the surface of the photoreceptor 1 from the charge eliminating device using light 15 composed of LED provided in a suitable position, to eliminate charge remaining on the surface of the photoreceptor 1.

In the examples 1 to 4 and the comparative examples 1 to 3, the position of the electrometer 2 provided so as to correspond to the position of the developing device as described above and the position of the charge eliminating device using light 15 were suitably changed, to change a time period elapsed from charging by the charger 11 until the surface potential on the photoreceptor 1 is measured by the electrometer 2, that is, a time period t1 from charging to development and a time period t2 from charge elimination by the charge eliminating device using light 15 to charging by the charger 11 as shown in the following Table 1 , to adjust the value of t2/t1 as shown in the same Table.

The surface potential on the photoreceptor 1 charged by the charger 11 was measured by the electrometer 2, to find the amount of charge required to so charge the photoreceptor 1 by the charger 11 that the surface potential thereon is +600 V. The results thereof were together shown in the following Table 1 .

TABLE 1

| | peripheral speed (mm/s) | t1 (msec) | t2 (msec) | t2/t1 | amount of charge ($\mu$C/cm$^2$) |
|---|---|---|---|---|---|
| example 1 | 250 | 150 | 150 | 1.0 | 0.20 |
| comparative example 1 | 250 | 300 | 150 | 0.5 | 0.22 |
| example 2 | 500 | 75 | 75 | 1.0 | 0.24 |
| comparative example 2 | 500 | 150 | 75 | 0.5 | 0.30 |
| example 3 | 750 | 50 | 50 | 1.0 | 0.24 |
| example 4 | 750 | 50 | 75 | 1.5 | 0.21 |
| comparative example 3 | 750 | 100 | 50 | 0.5 | 0.36 |

As a result, according to the method in each of the examples in which the value of t2/t1 which is the ratio of the time period t1 from charging to development to the time period t2 from charge elimination to charging was not less than one, the amount of charge required to so charge the photoreceptor 1 by the charger 11 that the surface potential thereon is a predetermined potential was smaller, as compared with that in a method in each of the comparative examples in which the value of t2/t1 was less than one, whereby the charging efficiency in the photoreceptor 1 was improved. Further, even when the peripheral speed of the photoreceptor 1 was made as high as 750 mm/s, the amount of charge required to so charge the photoreceptor 1 that the surface potential thereon is a predetermined potential was small.

Although the present invention has been fully described by way of example, it is to be noted that various changes and modification will be apparent to those skilled in the art.

Therefore, unless otherwise such changes and modifications depart from the scope of the present invention, they should be construed as being included therein.

What is claimed is:

1. An image forming method comprising the steps of: charging a surface of an amorphous silicon photoreceptor having an amorphous silicon photosensitive layer;

subjecting the charged amorphous silicon photoreceptor to exposure corresponding to image information, to form an electrostatic latent image;

supplying toner to the electrostatic latent image from a developing device to perform development, to form a toner image on the surface of the amorphous silicon photoreceptor;

transferring the toner image onto a transfer member;

cleaning the toner remaining on the surface of the amorphous silicon photoreceptor after the transfer by a cleaning device;

irradiating light onto the surface of the amorphous silicon photoreceptor after the cleaning, to eliminate charge remaining on the amorphous silicon photoreceptor; and repeating the abovementioned steps in sequence, letting t1 be a time period from the charging step to the developing step, and t2 be a time period from the charge eliminating step, to the charging step, t1 and t2 satisfying t2/t1$\geqq$1, said time period t2 being less than 200 msec.

2. The image forming method according to claim 1, wherein said time periods t1 and t2 satisfy 2$\geqq$t2/t1$\geqq$1.

3. The image forming method according to claim 1, wherein said time period t2 is 30 to 180 msec.

4. The image forming method according to claim 1, wherein the thickness of said amorphous silicon photosensitive layer is 20 to 100 $\mu$m.

5. The image forming method according to claim 4, wherein the thickness of said amorphous silicon photosensitive layer is 50 to 100 $\mu$m.

6. The image forming method according to claim 1, wherein the speed at which the surface of said amorphous silicon photoreceptor is moved is 200 to 1000 mm/sec.

7. The image forming method according to claim 1, wherein the toner recovered by said cleaning device is supplied again to the developing device.

8. An image forming method comprising the steps of:

positively charging a surface of an amorphous silicon photoreceptor having an amorphous silicon photosensitive layer;

subjecting the charged amorphous silicon photoreceptor to exposure corresponding to image information, to form an electrostatic latent image;

supplying positively charged toner to the electrostatic latent image from a developing device to perform reversal development, to form a toner image on the surface of the amorphous silicon photoreceptor;

transferring the toner image onto a transfer member;

cleaning the toner remaining on the surface of the amorphous silicon photoreceptor after the transfer by a cleaning device;

irradiating light onto the surface of the amorphous silicon photoreceptor after the cleaning, to eliminate charge remaining on the amorphous silicon photoreceptor; and repeating the abovemetioned steps in sequence, letting t1 be a time period from the charging step to the developing step, and t2 be a time period from the charge eliminating step to the charging step, t1 and t2 satisfying $t2/t1 \geqq 1$, said time period t2 being less than 200 msec.

9. The image forming method according to claim 8, wherein said time periods t1 and t2 satisfy $2 \geqq t2/t1 \geqq 1$.

10. The image forming method according to claim 8, wherein said time period t2 is 30 to 180 msec.

11. The image forming method according to claim 8, wherein the thickness of said amorphous silicon photosensitive layer is 20 to 100 $\mu$m.

12. The image forming method according to claim 11, wherein the thickness of said amorphous silicon photosensitive layer is 50 to 100 $\mu$m.

13. The image forming method according to claim 8, wherein the speed at which the surface of said amorphous silicon photoreceptor is moved is 200 to 1000 mm/sec.

14. The image forming method according to claim 8, wherein the toner recovered by said cleaning device is supplied again to the developing device.

* * * * *